US006000990A

United States Patent [19]

Wong

[11] Patent Number: 6,000,990

[45] Date of Patent: Dec. 14, 1999

[54] TUMBLING TOY WITH FREELY MOVABLE LIMBS

[75] Inventor: Tak-Ko Wong, Hong Kong, The Hong Kong Special Administrative Region of the People's Republic of China

[73] Assignee: T. K. Wong & Associates Ltd., Chaiwan, The Hong Kong Special Administrative Region of the People's Republic of China

[21] Appl. No.: 09/033,291

[22] Filed: Mar. 2, 1998

[30] Foreign Application Priority Data

Mar. 4, 1997 [GB] United Kingdom ..... 9704480

[51] Int. Cl.[6] ..... A63H 11/08; A63H 17/00

[52] U.S. Cl. ..... 446/324; 446/431

[58] Field of Search ..... 446/324, 325, 446/289, 431, 437, 390, 376, 382

[56] References Cited

U.S. PATENT DOCUMENTS

| | | | |
|---|---|---|---|
| 3,277,602 | 10/1966 | Speers et al. | 446/390 X |
| 3,645,038 | 2/1972 | Morrison et al. | 446/390 X |
| 4,884,989 | 12/1989 | Wong | 446/324 X |
| 5,683,285 | 11/1997 | Wong | 446/324 X |

*Primary Examiner*—D Neal Muir
*Attorney, Agent, or Firm*—Jackson Walker L.L.P.

[57] ABSTRACT

A humanoid toy that under the influence of gravity will travel down a vertical surface, while tumbling as sticky regions temporarily and in turn stick to the surface in known manner, the toy comprising a body and two pairs of limbs that are hingedly connected to the body. Each limb is formed in two parts that are hingedly connected together intermediate its length.

5 Claims, 1 Drawing Sheet

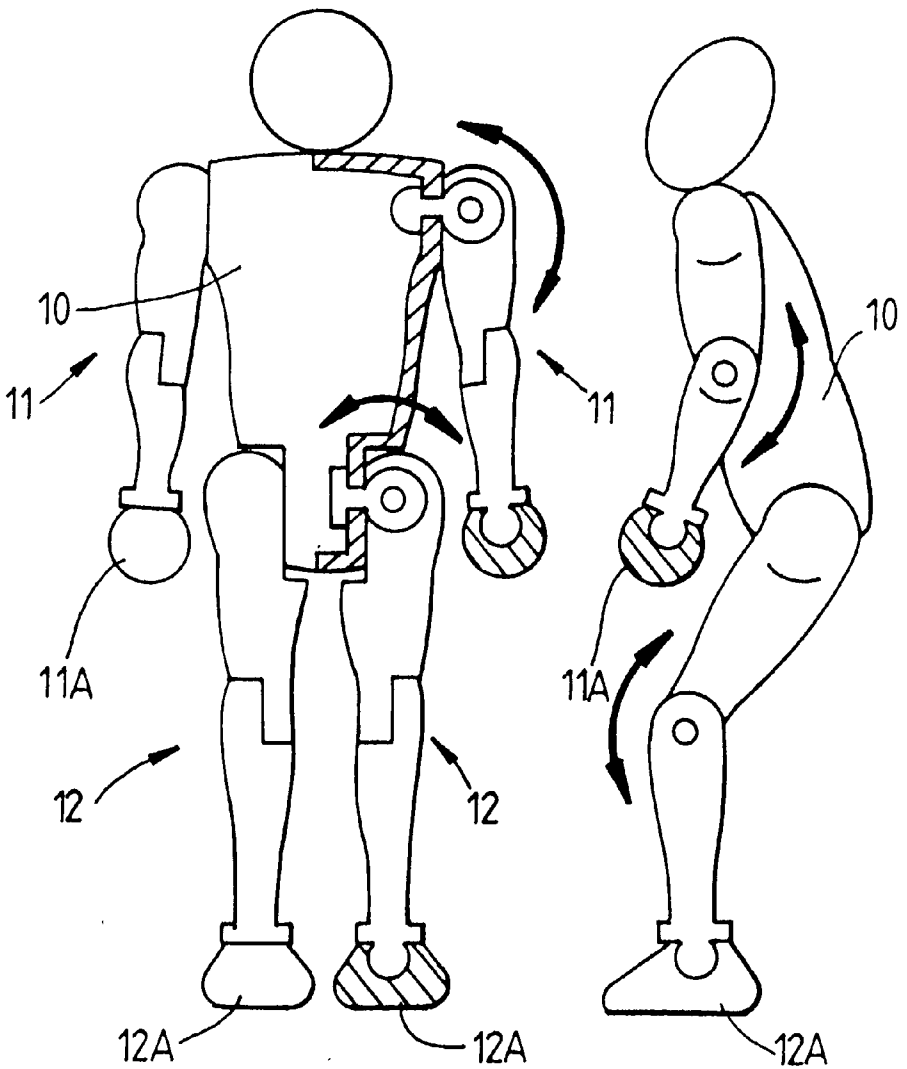
FIG. 2
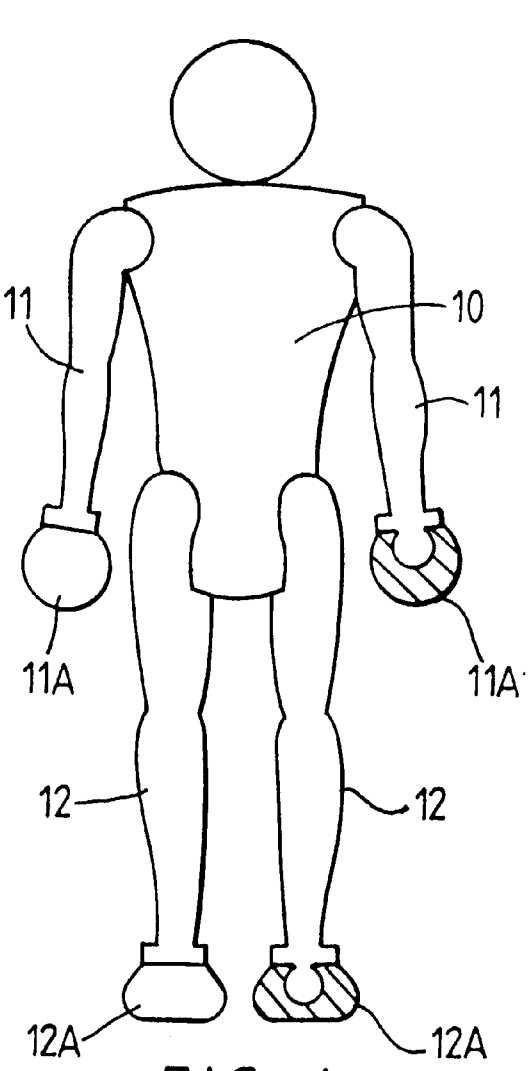
FIG. 1
FIG. 3

TUMBLING TOY WITH FREELY MOVABLE LIMBS

BACKGROUND OF THE INVENTION

1. Field of the Invention

The invention relates to a toy.

2. Description of Prior Art

The invention relates to a toy which under the influence of gravity will travel down a substantially vertical surface and is provided with sticky material at extremities of its limbs, such a toy is claimed and described in U.K. Patent 2222958.

SUMMARY OF THE INVENTION

According to the invention there is provided a toy which under the influence of gravity will travel down a substantially vertical surface, said toy comprising a body, a pair of limbs connected to and extending away from each end of the body, and a region of sticky material at the remote end of each limb, in which the limbs are arranged to bend along their lengths and with respect to the body, the adhesivity of the material being selected so that said regions of sticky material will adhere to the surface when they first contact the surface and then under the influence of gravity acting on the toy the upper of said regions or region will become detached from the surface so as to free said toy to rotate or tumble about its body to move successively down the surface.

The limbs may be formed of floppy or flexible plastics material, or rigid material. The limbs may be formed of flexible material that includes flexible plastics, bendable wire with or without a plastic sheath. The rigid material includes plastics, wood or metal, or combinations thereof.

If the limbs are rigid or partly rigid, each limb is preferably pivotably attached to the body and has at least one pivotable joint intermediate its length.

The toy may be in various forms including a humanoid form, animal form, bird form, and insect form with three pairs of limbs for example.

BRIEF DESCRIPTION OF THE DRAWINGS

Toys in the form of a humanoid according to the invention will now be described by way of example with reference to the accompanying schematic drawings in which:

FIG. 1 is a front view of one toy;

FIG. 2 is a part-sectional front view of another toy; and

FIG. 3 is a side view of the toy of FIG. 2 in a slightly bent posture, and

DESCRIPTION OF THE PREFERRED EMBODIMENT

Referring to the drawings, the toys each have a body 10 and two pairs of limbs 11 and 12 connected at each end of the body 10. At the remote end of each limb there is a respective region of sticky material 11A and 12A. Various sticky materials can be used. Examples can be found in U.S. Pat. No. 4,764,148.

The upper and lower limbs (the arms and legs) of the toy in FIG. 1 are made of plastic coated flexible metal wire so that the arms and legs are generally springy or floppy. In practice, this allows the arms and legs to be generally "thrown about" as the toy tumbles down a vertical surface. The sticky regions 11A and 12A cling temporarily and in turn to the surface as the toy tumbles and rolls about its own body 10 in a generally haphazard and playful manner as the toy moves down the surface.

The toy in FIGS. 2 and 3 has arms and legs that are made of more rigid material. The arms and legs are each formed of two parts, which are hinged together to simulate elbows and knees respectively. The arms and legs are hingedly connected to the body to simulate shoulder and hip joints. The toy of FIGS. 2 and 3 tumbles down a vertical surface in a generally known manner. The simulated joints (elbows, hips, etc) tend to cause the toy to behave in a somewhat more reliable, predictable and life-like manner than the toy of FIG. 1; such a characteristic for a humanoid shaped toy is sometimes more desirable and interesting for a player.

Whereas humanoid toys have been described, the toy may comprise other shapes including animals, birds where the limbs comprise moveable wings, and insects with say three pairs of limbs. The limbs described in FIG. 1, and some sections he limbs described in FIGS. 2 and 3, may also comprise or include flexible plastics material, or rubber.

I claim:

1. A tumbling toy which under the influence of gravity will travel down a substantially vertical surface, said tumbling toy comprising a body, at least a pair of independent, fully rotatable limbs, each limb having an intermediate joint free to articulate under the influence of gravity, the limbs connected to and extending away from each end of the body, and a region of sticky material at the remote end of each limb, the adhesivity of the material being selected so that said regions of sticky material will adhere to the surface when they first contact the surface and then under the influence of gravity acting on the toy the upper of said regions or region will become detached from the surface so as to free said toy to rotate or tumble about its body to move successively down the surface.

2. A toy according to claim 1, in which the limbs are formed of floppy plastics material.

3. A toy according to claim 1, in which the limbs are formed of a composition selected from the group consisting of rigid plastics, wood and metal pivotably attached to said body.

4. A toy according to claim 1, having a humanoid form.

5. A toy according to claim 1, having an insect form with at least three pairs of limbs.

* * * * *